US006161557A

United States Patent [19]

Wakabayashi

[11] Patent Number: 6,161,557

[45] Date of Patent: Dec. 19, 2000

[54] METHOD AND APPARATUS FOR WASHING MANUFACTURING LINE OF DRINK OR THE LIKE

[75] Inventor: Norimitsu Wakabayashi, Kawasaki, Japan

[73] Assignee: Showa Tansan Co., Ltd., Kanagawa-ken, Japan

[21] Appl. No.: 09/219,066

[22] Filed: Dec. 22, 1998

[51] Int. Cl.[7] ..... B08B 9/00

[52] U.S. Cl. ..... 134/22.13; 134/27; 134/28; 134/29

[58] Field of Search ..... 134/22.13, 22.14, 134/22.17, 22.19, 27, 28, 29

[56] References Cited

U.S. PATENT DOCUMENTS

| | | | |
|---|---|---|---|
| 1,642,419 | 9/1927 | Loew | 134/22.17 |
| 2,817,606 | 12/1957 | Barrett | 134/22.17 |
| 2,916,406 | 12/1959 | Bulatkin | 134/22.17 |
| 3,537,897 | 11/1970 | Kington | 134/22.13 |

*Primary Examiner*—Randy Gulakowski
*Assistant Examiner*—Saeed Chaudhry
*Attorney, Agent, or Firm*—Jordan and Hamburg LLP

[57] ABSTRACT

The rinse washing of the present invention is completed in a short time by washing with a rinse washing liquid including a safe carbonic water or a carbonic acid gas after the manufacturing line is washed by an alkaline washing liquid when the manufacturing line is washed so that the present invention can reduce the water and energetic waste and can drive the manufacturing line efficiently.

14 Claims, 15 Drawing Sheets

METHOD AND APPARATUS FOR WASHING MANUFACTURING LINE OF DRINK OR THE LIKE

BACKGROUND OF THE INVENTION

The present invention is related to a method and apparatus for washing manufacturing line which is washed without the fact that the manufacturing line of fluid food, drinking water or the like is disjointed.

The conventional method and apparatus for washing is used as named "CIP". The rinse washing is performed by washing water, and the acidity washing and intermediate rinse washing are performed by acid washing water. Also, the alkaline washing is performed by alkaline washing water. After that, the finish rinse washing is performed by washing water.

In the conventional method for washing, when the finish rinse washing is performed, it needs to be performed till the washed finish rinse washings becomes a neutral condition. Therefore, the finish rinse washings must be used in a draining condition for 20 to 30 minutes, and the rinse washing water is used in large quantities. Furthermore, drive time of a pump to flow the rinse washing water also takes a long time, and it costs at high cost for washing. If the rinse washing water which is used in a large quantities is not managed, it can not be drained, it has a trouble with management of the rinse washing water.

In addition, in order to wash the manufacturing line of expensive drinking water, it is made to have to stop a long interval. Also, the manufacturing line of drinking water is not made to be able to operate efficiently.

SUMMARY OF THE INVENTION

In view of the foregoing, it is an object of the present invention to provide a method and apparatus for washing manufacturing line of drink which rinse washing is completed in a short time, by washing it in the rinse washing water including safe carbonic acid water or carbonic acid gas after washing by alkaline washing liquid, and water and energy wastes can be reduced. It is another object of the present invention to provide a method and apparatus for washing the manufacturing line of drink that manufacturing line of expensive drink is made to be,able to operate efficiently.

The novel features which are believed to be characteristic of the invention, both as to its organization and method of operation, together with further projects and advantages thereof will be better understood from the following description considered in connection with accompanying drawings in which a presently preferred embodiment of the invention is illustrated by way of example. It is to be expressly understood, however, that the drawings are for the purpose of illustration and description only, and are not intended as a definition of the limits of the invention.

DESCRIPTION OF THE PREFERRED EMBODIMENT

Figure 1:
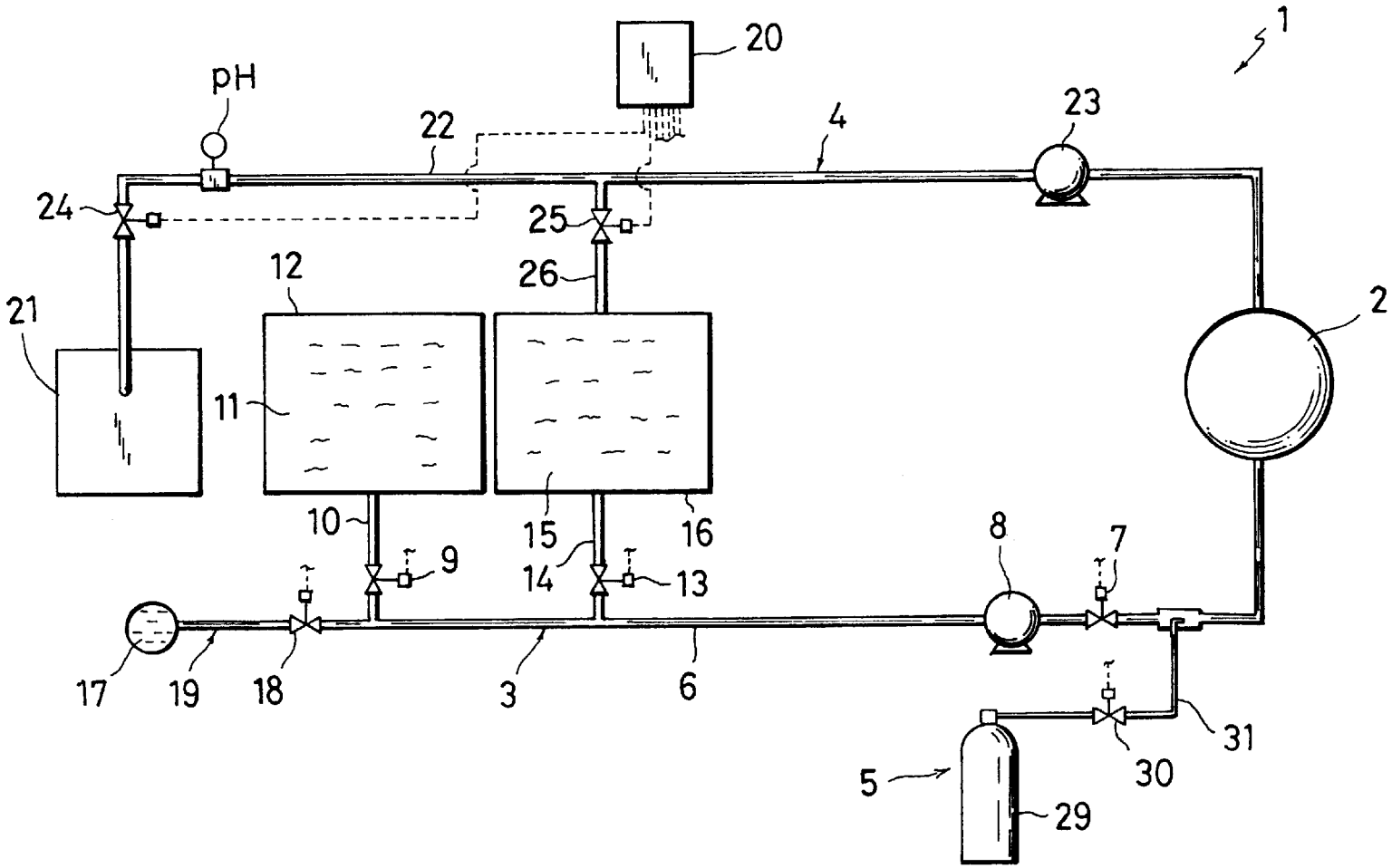
FIG. 1 is a schematic explanation view showing a first embodiment of the present invention.

Preferred embodiments of the present invention are described in more detail below referring to the accompanying drawing.

An understanding of the present invention may be best gained by reference to FIGS. 1 to 6. FIGS. 1 to 6 illustrate an apparatus for washing the manufacturing line of drink of the present invention. Numeral 1 is an apparatus for washing the manufacturing line of drink that it is referred as CIP equipment which without the fact that it disjoints the manufacturing line of drink such as a soft drink, natural water, juice, ketchup, mayonnaise or the like and comprises a tank of every kind, a plate, a plumbing and the other structural objects. The washing apparatus 1 comprises a washing liquid supply device 3, a drain route 4 and a carbonic acid gas supply device 5. The washing liquid supply device 3 is connected to a beginning upper stream portion of the section which requires the washing of the manufacturing line 2. The drain route 4 is connected to a final lower stream portion of the section which requires the washing of the manufacturing line 2. The carbonic acid gas supply equipment 5 supplies carbonic acid gas when the washing liquid supply device 3 supplies the rinse washing liquid after an alkaline washing liquid supply is supplied.

In order that CIP equipment is composed such that it is established, the manufacturing line 2 may be composed what kind of manufacturing line.

The washing water supply device 3 further comprises a washing liquid supply pipe 6, a solenoid openable closure valve 7, a sanitary pump 8, a rinse washing liquid storage chamber 12 and an alkaline washing liquid storage chamber 16, a clean water washing liquid supply device 19, and a controlling device 20. The washing liquid supply pipe 6 is connected to a section of a beginning upper stream of the section which requires washing of the manufacturing line 2. The solenoid openable closure valve 7 has interposed in a downstream section at the washing liquid supply pipe 6. The sanitary pump 8 has interposed in the washing liquid supply pipe 6. The rinse washing liquid storage chamber 12 is connected to the washing water supply pipe 6 located at an upper section of sanitary pump 8 through the diverging pipe 10 having a solenoid openable closure valve 9, the washing liquid storage chamber 12 being stored a rinse washing liquid 11 with warm-water therein. The alkaline washing liquid storage chamber 16 is connected to the washing liquid supply pipe 6 located at an upper section of sanitary pump 8 through diverging pipe 14 having a solenoid openable closure valve 13, the alkaline washing liquid storage chamber 16 being stored an alkaline washing liquid 15 therein. The clean water washing liquid supply device 19 is connected to an upper section of the washing liquid supply pipe 6 and supplies a clean water washing liquid 17 or water service water through a solenoid openable closure valve 18. The controlling device 20 allows the sanitary pump 8 drive and allows the solenoid openable closure valve 7 of the sanitary pump 8, solenoid openable closure valve 18 of the clean water washing liquid supply device 19, solenoid openable closure valve,9 of the rinse washing liquid 11 of warm water, and a solenoid openable closure valve 13 of alkaline washing liquid 15 opens at a fixed time in the order which is decided beforehand.

The drain route 4 is composed of a drainpipe 22, a sanitary pump 23 for draining, a solenoid openable closure valve 24, a recovery diverging pipe 26 and a pH measuring device PH. The drainpipe 22 is connected to a final down stream portion required the washing of the manufacturing line of drink or the like, the drainpipe 22 draining to a transacting chamber 21. The sanitary pump 23 is interposed between the drainpipes 22. The solenoid openable closure valve 24 is interposed at the down stream portion of the drainpipe 22. The recovery diverging pipe 26 is connected with the drainpipe 26 22 located at the up stream portion to the valve 24 and the alkaline washing liquid storage chamber 16 in the down stream of the sanitary pump 23, the recovery diverging pipe 26 having a solenoid openable closure valve 25. The pH measuring device PH is interposed in the down stream portion of the drainpipe 22, the device PH measuring pH of the washed washing liquid which flows into the drainpipe 22. The solenoid openable closure valve 24 for draining, sanitary pump 23 for draining and the solenoid openable closure valve 25 of the recovery diverging pipe 26 are controlled by the controlling device 20 such that they are allowed themselves open in order which is decided beforehand.

Figure 2:
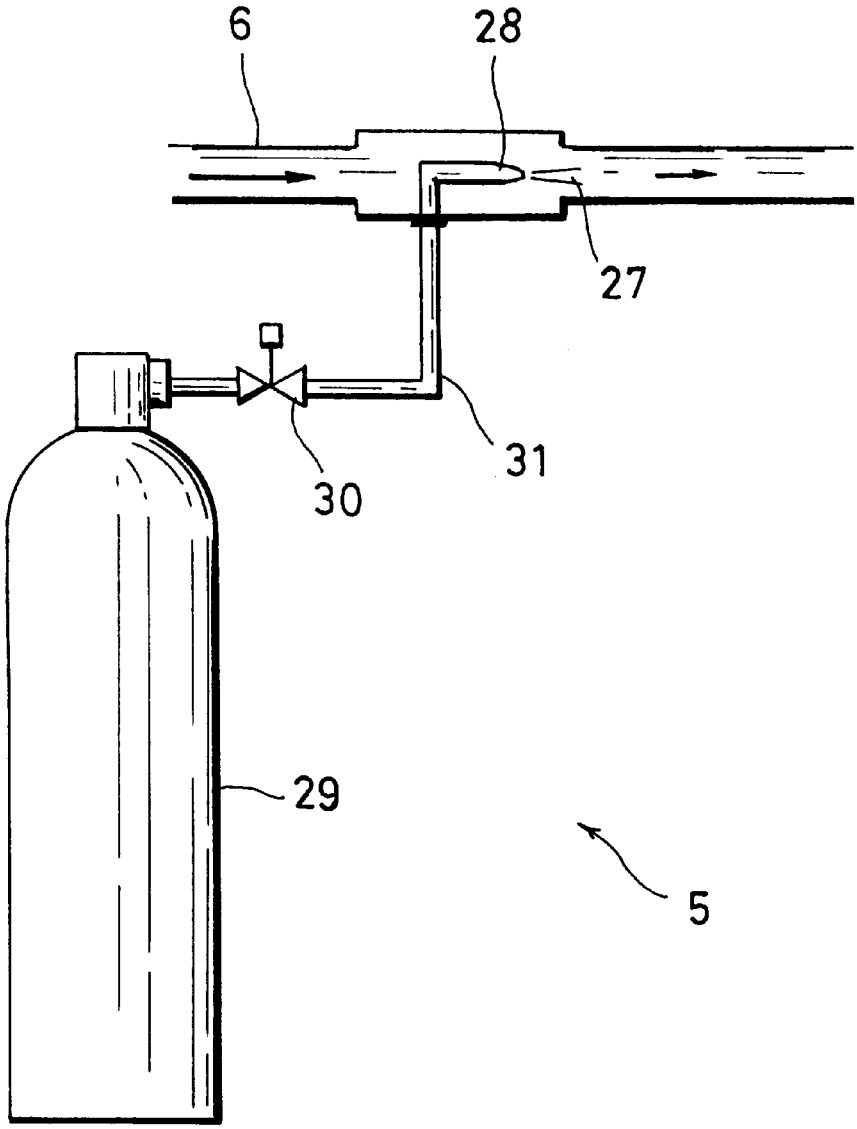
FIG. 2 is an explanation view of a carbonic acid gas supplying device showing a first embodiment of the present invention.

The carbonic acid gas supplying device 5 as illustrated in FIG. 2 is composed of a carbonic acid gas nozzle 28 and a carbonic acid gas supplying pipe 31. The carbonic acid gas nozzle 28 is attached such that the nozzle 28 can supply the carbonic acid gas 27 into to the washing liquid supplying pipe 6. The carbonic acid gas supplying pipe 31 supplies the carbonic acid gas 27 into the nozzle 28 from a carbonic acid gas cylinder 29 through a solenoid openable closure valve 30. The solenoid openable closure valve 30 is controlled by the controlling device 20 such that the valve 30 is opened at a fixed time under a condition which is decided beforehand.

Figure 3:
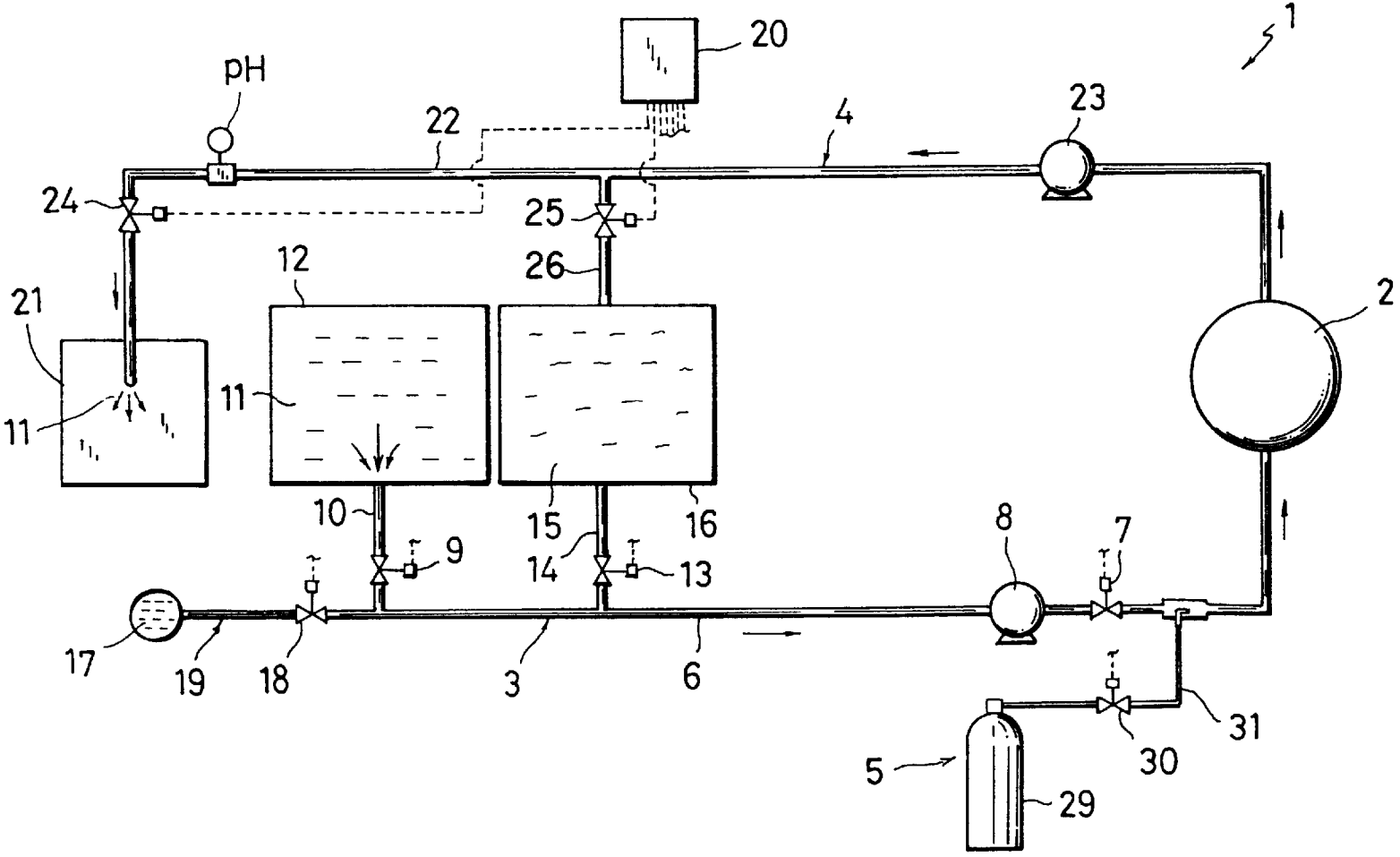
FIG. 3 is an explanation view of a rinse washing process showing a first embodiment of the present invention.

In the apparatus for washing the manufacturing line of drink 1 of the above-mentioned structure, as illustrated in FIG. 3, it allows the sanitary pump 8 and the sanitary pump 23 for draining drive, allowing the rinsing washing liquid 11 with warm-water or clean water washing liquid 17 pass at a fixed time to the manufacturing line 2 of drink or the like by opening selectively the solenoid openable closure valve 9 or 18 and opening the solenoid openable closure valve 7 or 24, and the rinse washing process is performed.

Figure 4:
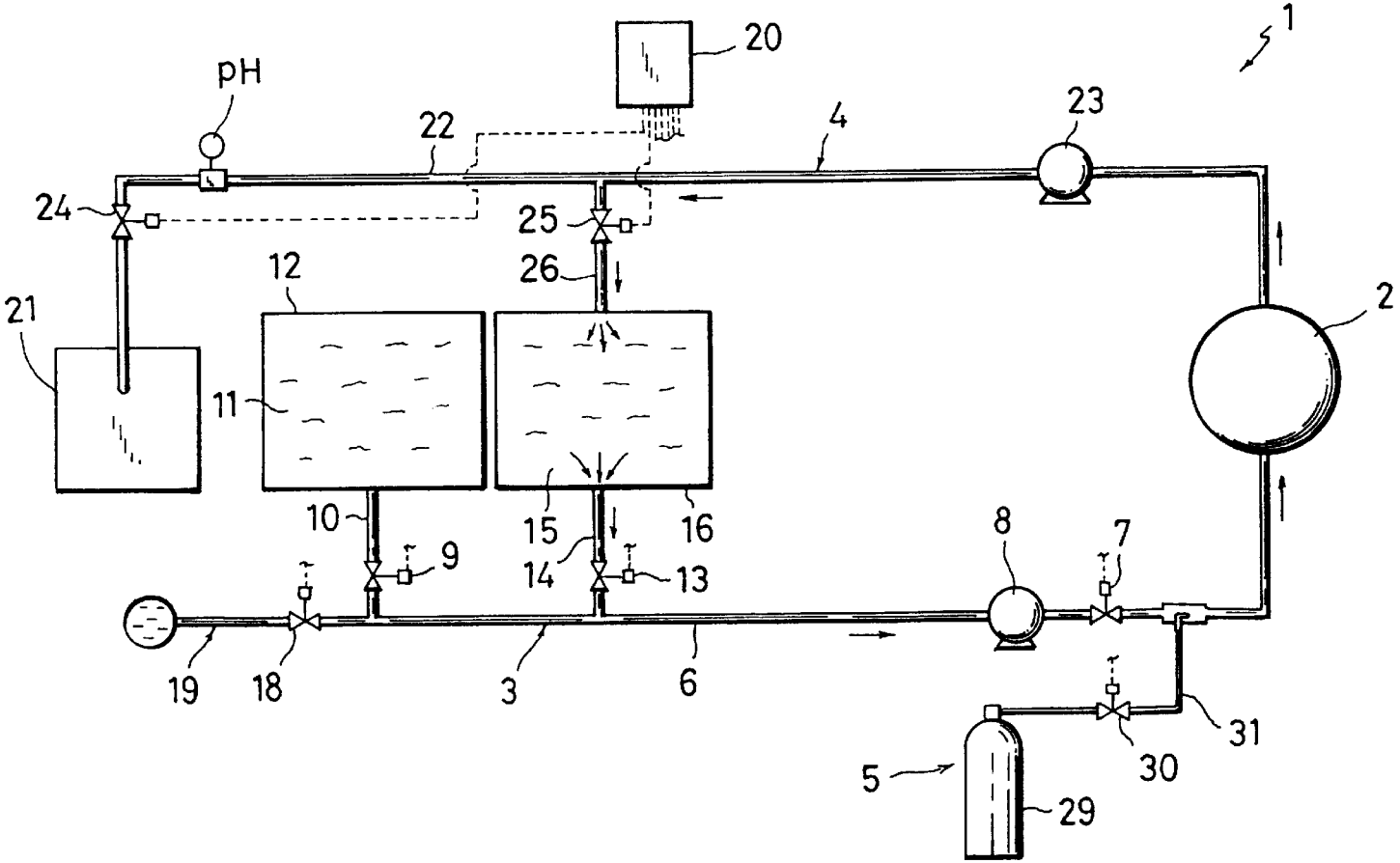
FIG. 4 is an explanation view of an alkaline washing process showing a first embodiment of the present invention.

As illustrated in FIG. 4, after the rinse washing process is performed, the solenoid openable closure valve 9 for the rinse washing liquid 11 with warm-water or the solenoid openable closure valve 18 for clean water washing liquid 17 are closed, then, the solenoid openable closure valve 13 for the alkaline washing liquid 15 is opened, the valve 13 allowing the alkali washing liquid 15 pass into the manufacturing line 2 of drink or the like at a fixed time. In this way, the alkaline washing process 23 is performed.

Furthermore, during performing the alkaline washing process 33, the value of pH of the alkaline washing liquid 15 which flows into the drainpipe 22 closes to that of the supplied alkaline washing liquid 15 by measuring the pH measuring device PH, the solenoid openable closure valve 25 of the recovery diverging pipe 26 is opened and the valve 24 for draining is closed, and the alkaline washing liquid 15 is introduced into the alkaline washing liquid storage chamber 16 and recovered therein.

Figure 5:
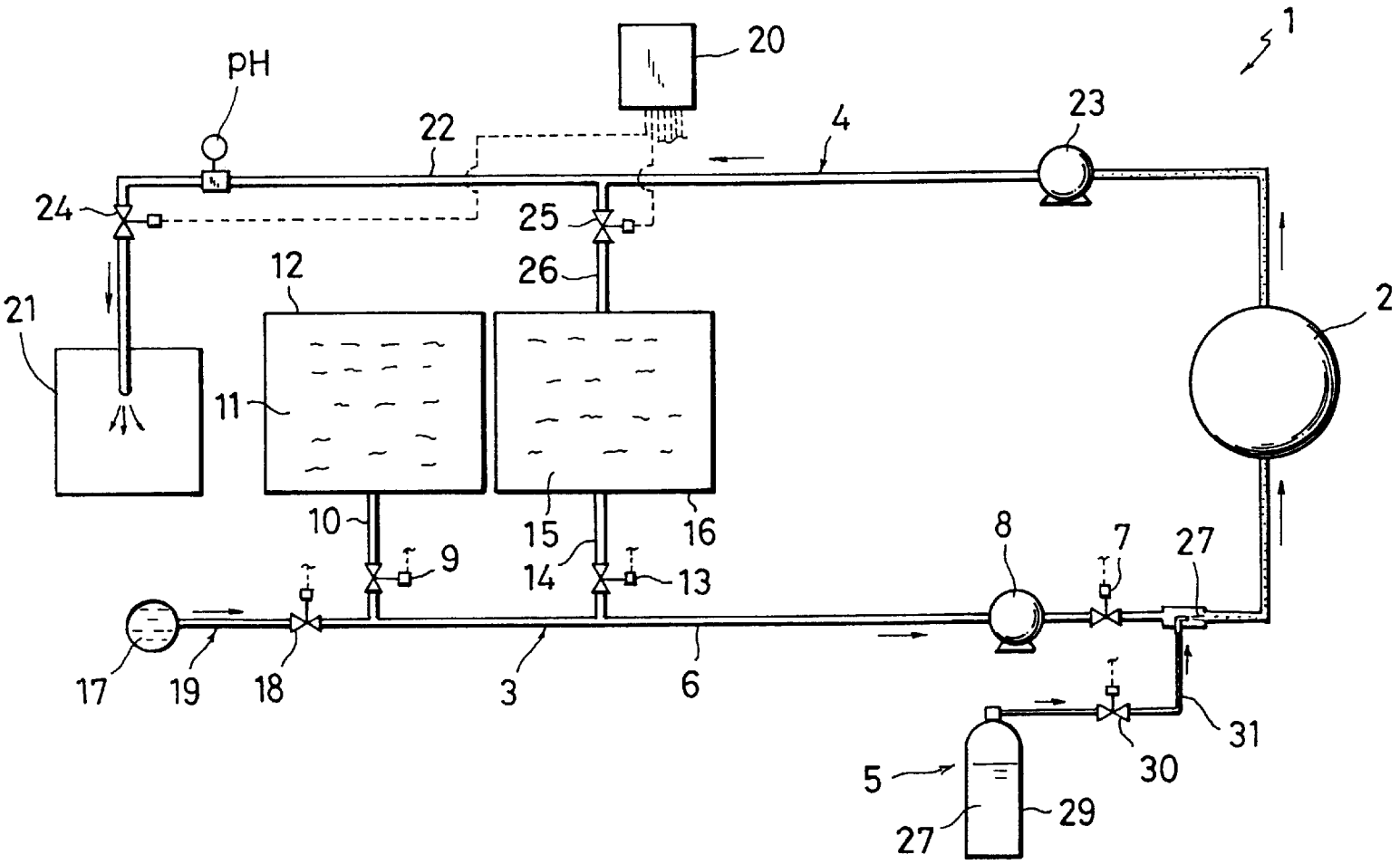
FIG. 5 is an explanation view of a finish rinse washing process showing a first embodiment of the present invention.
Figure 6:
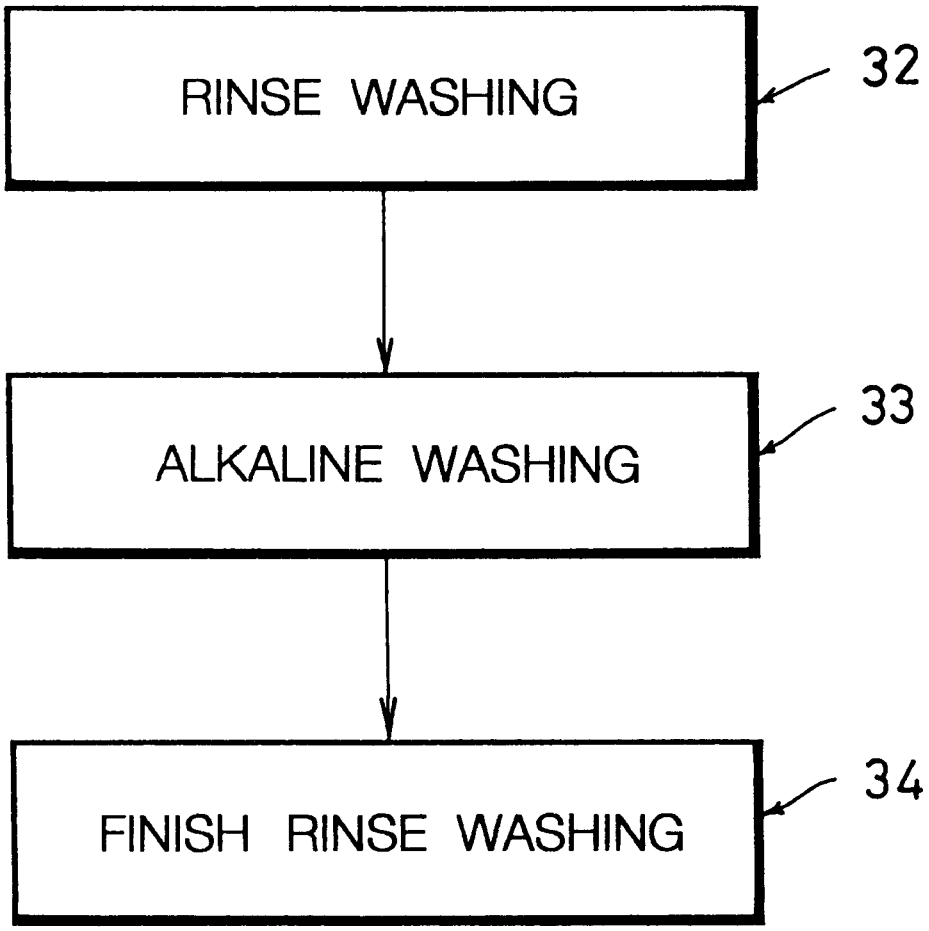
FIG. 6 is a flow diagram showing a first embodiment of the present invention.

As illustrated in FIG. 5, after the alkaline washing process 33 is performed, the solenoid openable closure valve 13 for the alkaline washing liquid 15 and the solenoid openable closure valve 25 of the recovery diverging pipe 26 are closed, the solenoid openbale closure valve 9 for the rinse washing liquid 11 with warm-water or the solenoid openbale closure valve 18 for the clean water washing liquid 17 is selectively opened, the rinse washing liquid 11 with warm-water or clean water rinse liquid 17 is allowed it pass through the manufacturing line 2 of drink or the like at a fixed time. In this way, the finish rinse washing process 34 is performed.

In this finish rinse washing process 34, the carbonic acid gas 27 is supplied into the rinse washing liquid 11 with warm-water or clean water washing liquid 17 from the carbonic acid gas supplying device 5 at a fixed time so that the alkaline washing liquid in the manufacturing line 2 of drink is neutralized by the carbonic acid gas 27, it is drained as a neutral rinse washing liquid 11 with warm-water or clean water washing liquid 17 in a short time. In this way, the finish rinse washing is finished.

DIFFERENT PREFERRED EMBODIMENT OF THE INVENTION

Other embodiments of the present invention will now be described referring to FIGS. 7 to 15. Through the drawings of the embodiment, like components are denoted by like numerals as of the first embodiment and will not be further explained.

Figure 7:
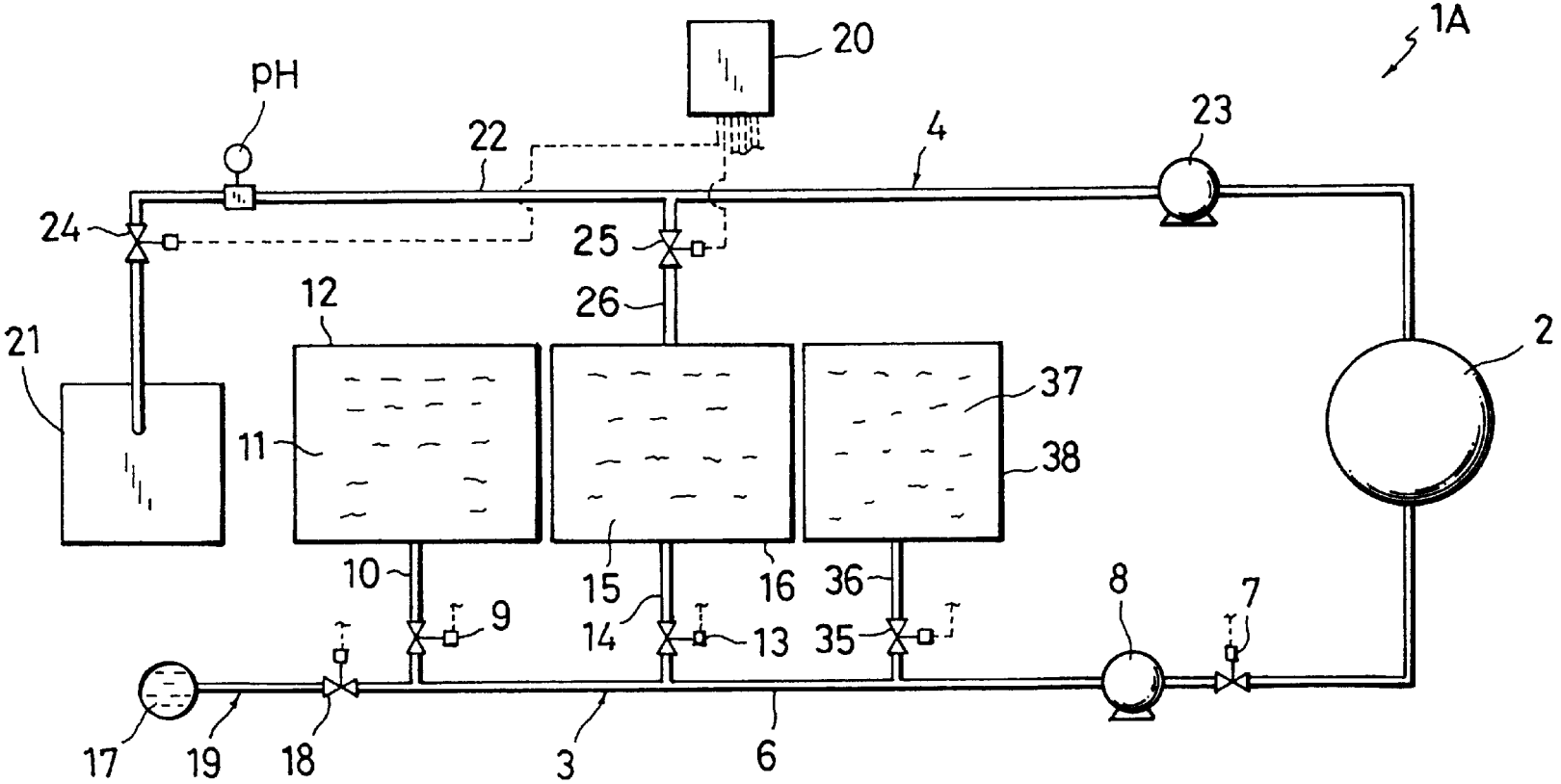
FIG. 7 is a schematic explanation view showing a second embodiment of the present invention.
Figure 8:
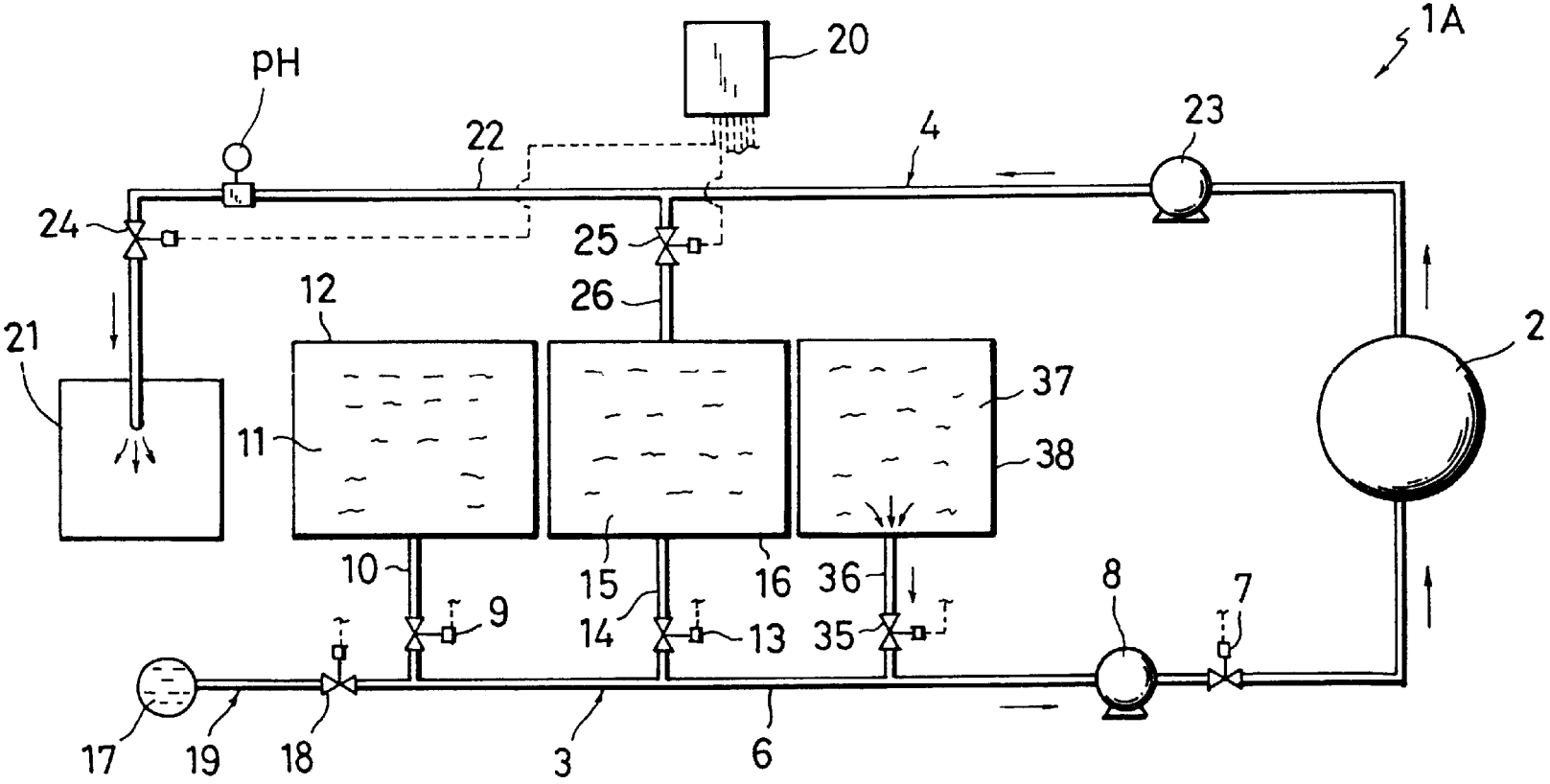
FIG. 8 is an explanation view of a finish rinse washing process showing a second embodiment of the present invention.
Figure 9:
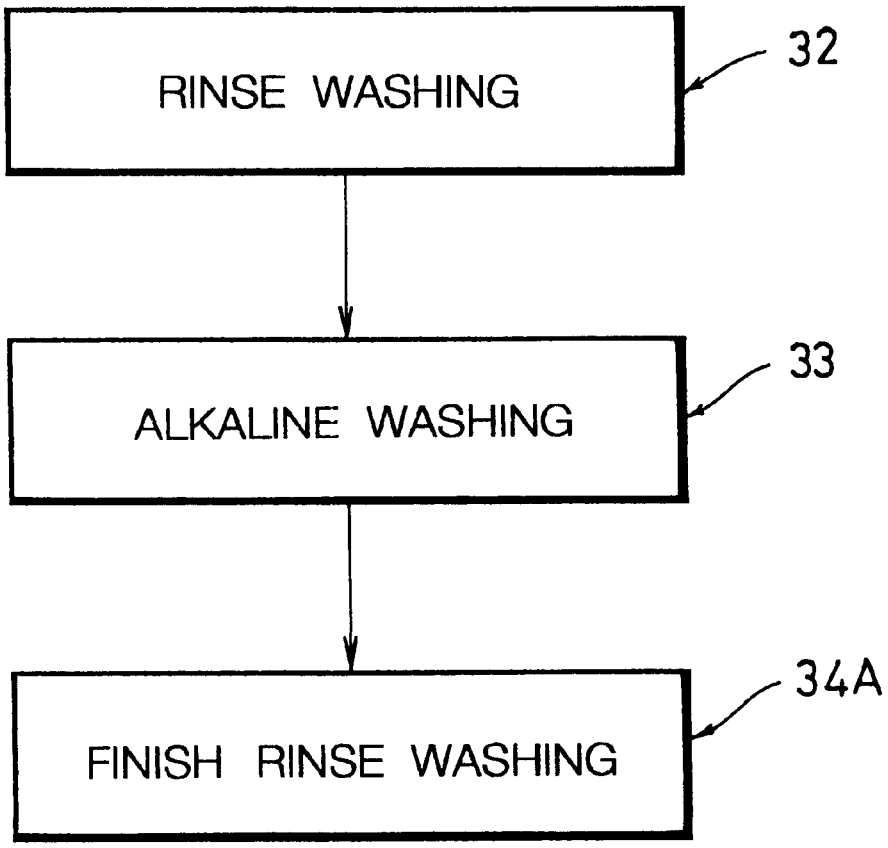
FIG. 9 is a flow diagram showing a second embodiment of the present invention.

A second embodiment of the present invention is shown in FIGS. 7 to 9. It is distinguished from the first embodiment by the fact that a carbonic acid washing liquid storage chamber 38 is connected to the washing liquid supplying pipe 6 through a diverging pipe 36 having a solenoid openable closure valve 35, the storage chamber 35 storing the carbonic acid washing liquid 37 therein. Also, the manufacturing line 2 is washed by the carbonic acid washing liquid 37 in a finish rinse washing process 34A. Accordingly, an apparatus for washing manufacturing line of drink or the like 1A of the second embodiment will provide the effects equal to those of the first embodiment.

Figure 10:
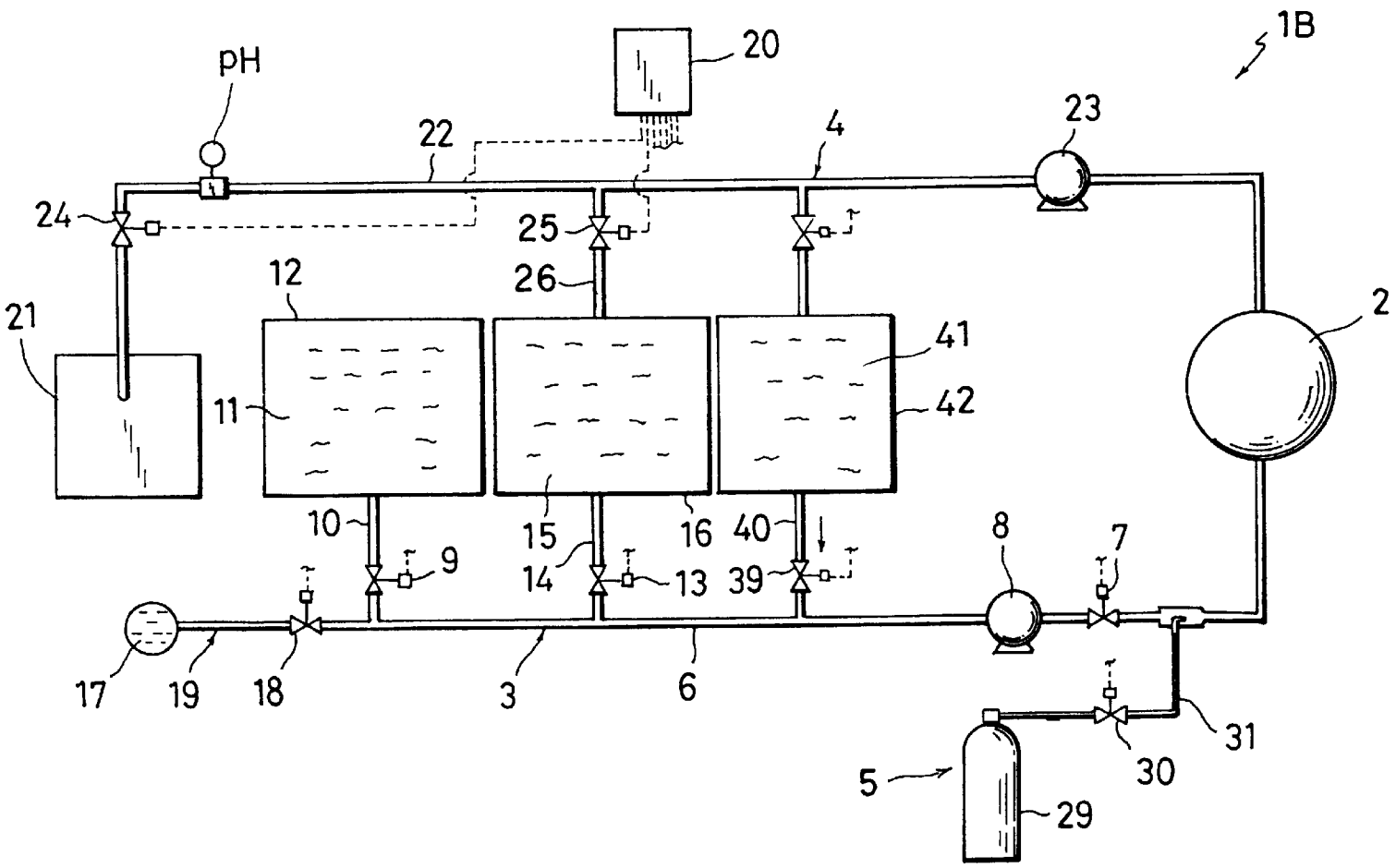
FIG. 10 is a schematic explanation view showing a third embodiment of the present invention.
Figure 11:
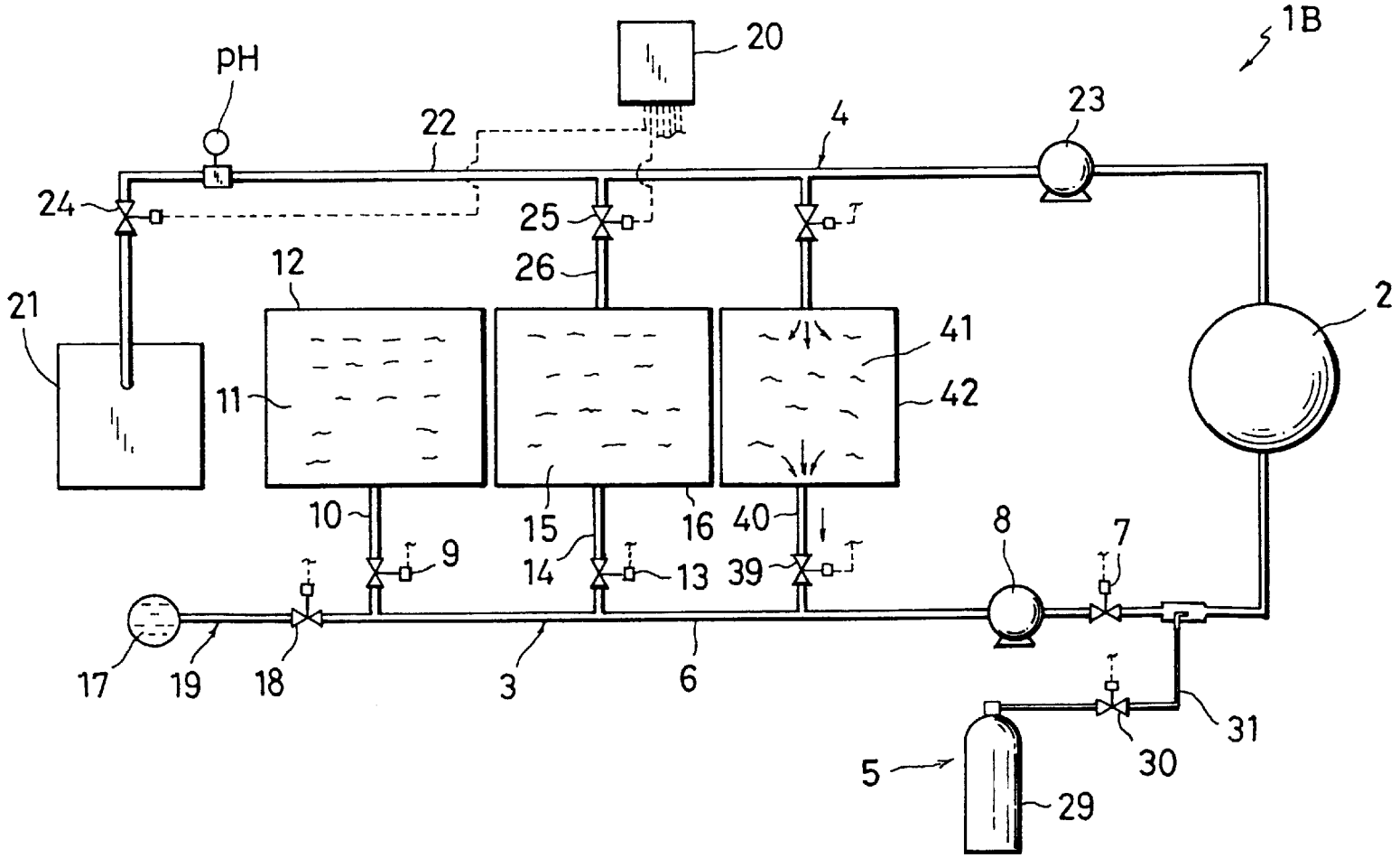
FIG. 11 is an explanation view of an acidity washing process showing a third embodiment of the present invention
Figure 12:
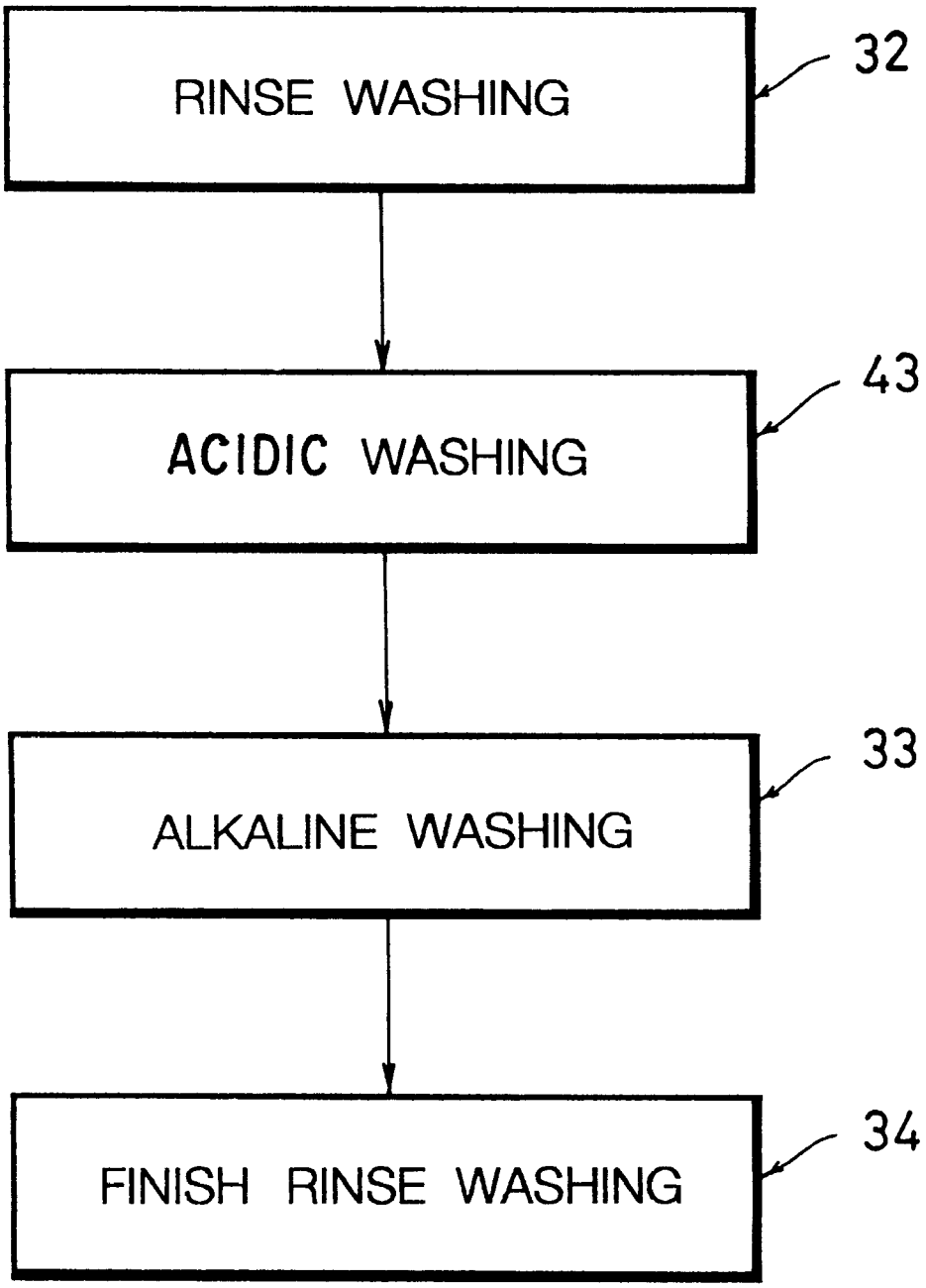
FIG. 12 is a flow diagram showing a third embodiment of the present invention.

A third embodiment of the present invention is shown in FIGS. 10 to 12. It is distinguished from the first embodiment by the fact that a carbonic acid washing liquid storage chamber 42 is connected to the washing liquid supply pipe 6 through a diverging pipe 40 having a solenoid openable closure valve 39, the storage chamber 42 storing an acid washing liquid 41 therein, and an acidity washing process 43 is performed between the rinse washing process 32 and alkaline washing process 33 by allowing the acid washing liquid 41 pass into the manufacturing line 2 of drink. Accordingly, an apparatus of washing manufacturing line of drink or the like 1B of the third embodiment will provide the effects equal to those of the first embodiment and the perfect washing is further performed.

Figure 13:
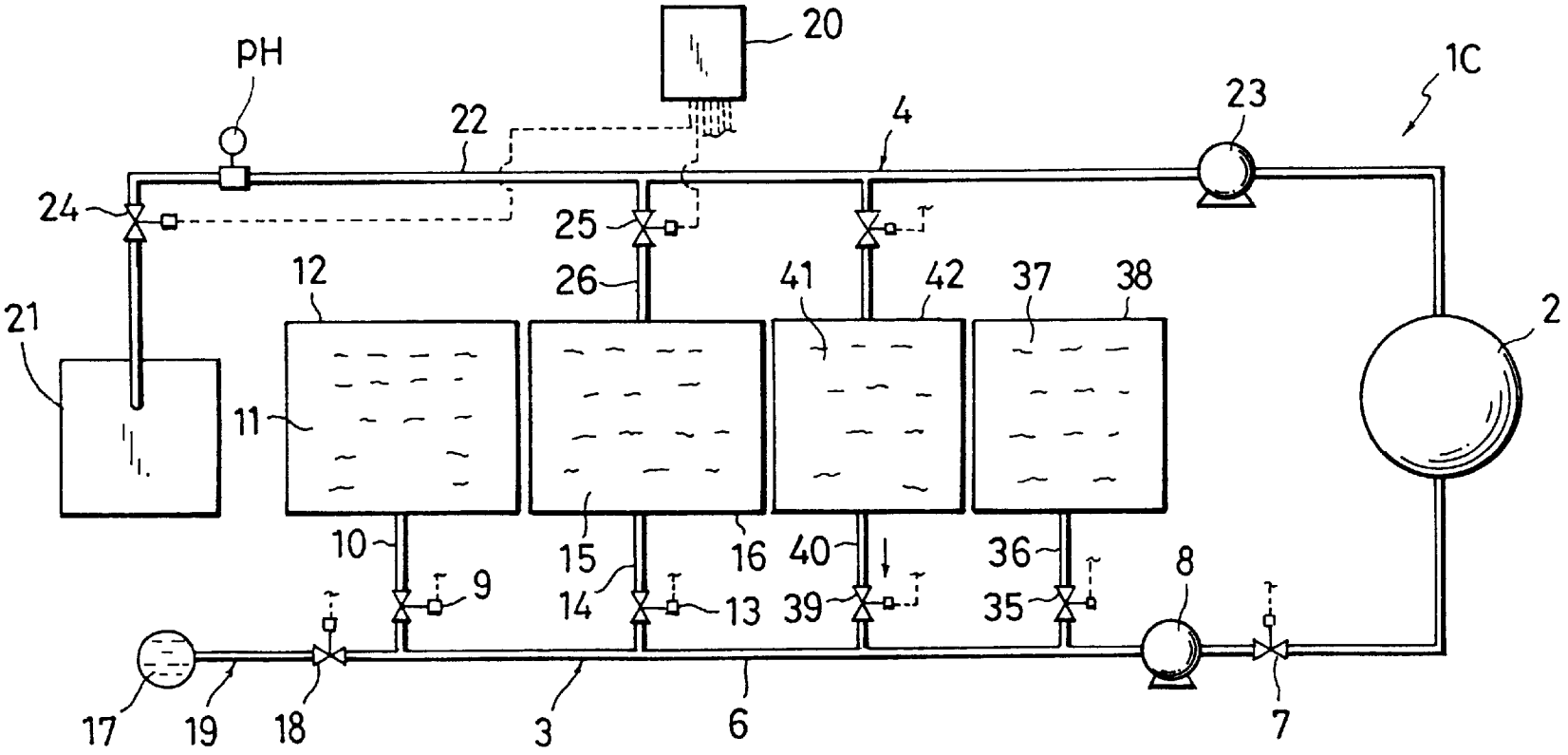
FIG. 13 is a schematic explanation view showing a fourth embodiment of the present invention.
Figure 14:
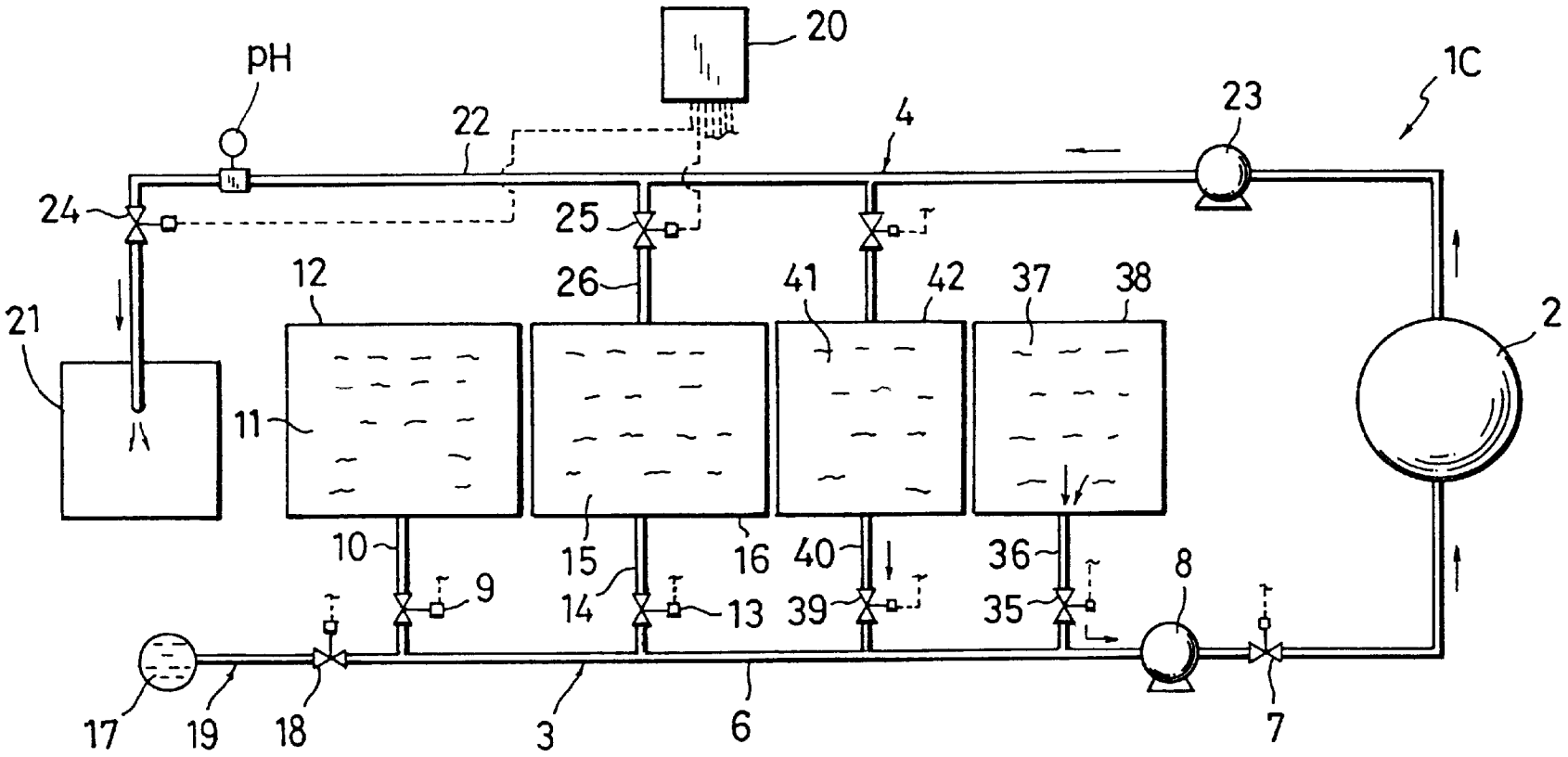
FIG. 14 is an explanation view of a finish rinse washing process showing a fourth embodiment of the present invention.
Figure 15:
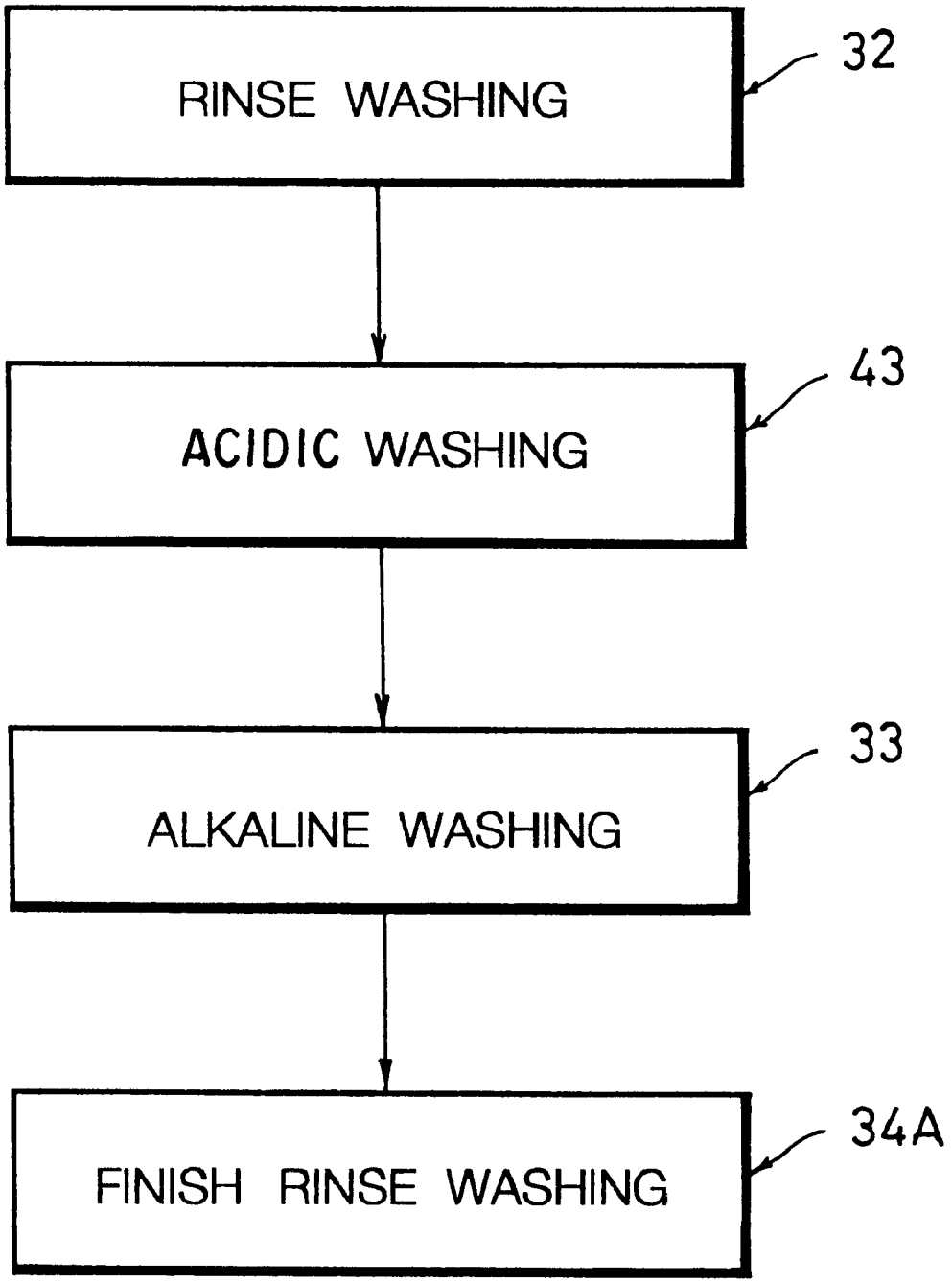
FIG. 15 is a flow diagram showing a fourth embodiment of the present invention.

A fourth embodiment of the present invention is shown in FIGS. 13 to 15. It is distinguished from the third embodiment by the fact that a carbonic acid washing liquid storage chamber 38 is connected to the washing liquid supplying pipe 6 through a diverging pipe 36 having a solenoid openable closure valve 35, the storage chamber 35 storing the carbonic acid washing liquid 37 therein. Also, the manufacturing line 2 is washed by the carbonic acid washing liquid 37 in the finish rinse washing process 34A. Accordingly, an apparatus for washing manufacturing line of drink or the like 1C of the fourth embodiment will provide the effects equal to those of the third embodiment.

ADVANTAGES OF THE INVENTION

As set forth above, the advantages of the present invention are as follows:

(1) A method for washing manufacturing line of drink or the like which comprises a rinse washing process passing rinse washing liquid such as normal-temperature water, warm-water or the like through the manufacturing line of the drink, the rinse washing process being performed; an alkaline washing process, after the rinse washing process is performed, passing alkaline washing liquid through manufacturing line of the drink, the alkaline washing being performed; and a finish rinse washing process, after the alkaline washing process is performed, passing carbonic acid gas washing liquid including carbonic acid washing liquid or carbonic acid gas through the manufacturing line of the drink or the like, the finish rinse washing being performed so that the finish rinsing process after the alkaline washing process is performed allows the carbonic acid gas washing liquid including the carbonic washing liquid or carbonic acid gas pass to the manufacturing line of drink and washes the manufacturing line, and therefore, the washing liquid after washing become a neutralization in a short time and the washing is finished.

Therefore, the washing liquid needs not continue to flow into the manufacturing line of drink in a long time until the washing liquid become a neutralization as a conventional way after washing, and the waste of the washing liquid can be reduced.

(2) As discussed above, the finish rinse washing can be performed in a short time so that the pump needs not allow it drive in a long time as a conventional way, and the waste of energy can be reduced.

(3) As discussed above, in order to perform the finish rinse washing in a short time, the carbonic acid gas washing liquid including the carbonic acid washing liquid or carbonic acid gas is used so that the washing operation can be performed safely with a low cost.

Therefore, the washing can be performed efficiently with a low cost.

(4) As discussed above, the finish rinse washing can be performed in a short time so that the manufacturing operation of the manufacturing line of the drink needs not be stopped in a long time as a conventional way, and the manufacturing line allows it drive efficiently, and its cost can be reduced.

What is claimed is:

1. A method of washing a manufacturing line for food products, comprising the steps of:

rinsing including passing a rinse washing liquid through the manufacturing line to effect rinsing thereof;

alkaline washing, after the rinsing, including passing an alkaline washing liquid through the manufacturing line to effect alkaline washing thereof; and finish rinsing, after the alkaline washing, including passing a carbonic acid gas washing liquid through the manufacturing line until liquid exiting the manufacturing line has a substantially neutral pH.

2. The method of claim 1 wherein the rinse washing liquid is one of normal-temperature water and warm-water.

3. The method of claim 2 wherein the carbonic acid gas washing liquid includes one a carbonic acid washing liquid and carbonic acid gas dissolved in water.

4. The method of claim 1 wherein the carbonic acid gas washing liquid includes one a carbonic acid washing liquid and carbonic acid gas dissolved in water.

5. The method of claim 1 wherein the step of finish rinsing includes:

monitoring a pH level of the liquid exiting the manufacturing line; and stopping the finish rinsing when the liquid exiting the manufacturing line has a substantially neutral pH.

6. The method of claim 1 wherein the step of the alkaline washing includes:

drawing the alkaline washing liquid from an alkaline washing liquid storage tank and passing the alkaline washing liquid through the manufacturing line; and draining the alkaline washing liquid from the manufacturing line back into the alkaline washing liquid storage tank.

7. A method of washing a manufacturing line for food products, comprising the steps of:

rinsing including passing a rinse washing liquid through the manufacturing line to effect rinsing thereof;

acidic washing, after the rinsing, including passing an acid washing liquid through the manufacturing line to effect an acid washing;

intermediate rinsing, after the acidic washing, including passing rinsing washing liquid through the manufacturing line to effect rinsing of the acid washing liquid from the manufacturing line;

alkaline washing, after the intermediate rinsing, including passing an alkaline washing liquid through the manufacturing line to effect alkaline washing thereof; and finish rinsing, after the alkaline washing, including passing a carbonic acid gas washing liquid through the manufacturing line until liquid exiting the manufacturing line has a substantially neutral pH.

8. The method of claim 7 wherein the rinse washing liquid is one of normal-temperature water and warm-water.

9. The method of claim 8 wherein the carbonic acid gas washing liquid includes one a carbonic acid washing liquid and carbonic acid gas dissolved in water.

10. The method of claim 7 wherein the carbonic acid gas washing liquid includes one a carbonic acid washing liquid and carbonic acid gas dissolved in water.

11. The method of claim 7 wherein the step of finish rinsing includes:

monitoring a pH level of the liquid exiting the manufacturing line; and stopping the finish rinsing when the liquid exiting the manufacturing line has a substantially neutral pH.

12. The method of claim 7 wherein the step of the alkaline washing includes:

drawing the alkaline washing liquid from an alkaline washing liquid storage tank and passing the alkaline washing liquid through the manufacturing line; and draining the alkaline washing liquid from the manufacturing line back into the alkaline washing liquid storage tank.

13. The method of claim 12 wherein the step of the acidic washing includes:

drawing the acid washing liquid from an acid washing liquid storage tank and passing the acid washing liquid through the manufacturing line; and draining the acid washing liquid from the manufacturing line back to the acid washing liquid storage tank.

14. The method of claim 7 wherein the step of the acidic washing includes:

drawing the acid washing liquid from an acid washing liquid storage tank and passing the acid washing liquid through the manufacturing line; and draining the acid washing liquid from the manufacturing line back to the acid washing liquid storage tank.

* * * * *